United States Patent [19]

Heuer et al.

[11] Patent Number: 4,739,353

[45] Date of Patent: Apr. 19, 1988

[54] PACKAGED CAMERA ASSEMBLY

[75] Inventors: William H. Heuer, Arlington Heights; Hari Matsuda, Evanston, both of Ill.

[73] Assignee: Ansco Photo-Optical Products Corporation, Elk Grove, Ill.

[21] Appl. No.: 96,544

[22] Filed: Sep. 14, 1987

[51] Int. Cl.[4] ..... G03B 29/00

[52] U.S. Cl. ..... 354/76; 206/45.31; 206/316

[58] Field of Search ..... 354/75, 76, 81, 354; 206/461, 316, 45.19, 45.31; 224/908

[56] References Cited

U.S. PATENT DOCUMENTS

| | | | |
|---|---|---|---|
| 3,278,015 | 10/1966 | Bernstein | 206/461 |
| 4,085,845 | 4/1978 | Perfect | 206/45.19 |
| 4,093,010 | 6/1978 | Hunley et al. | 206/316 |
| 4,180,165 | 12/1979 | Kuchenbecker | 206/461 |
| 4,235,336 | 11/1980 | Dudas et al. | 206/461 |
| 4,595,102 | 6/1986 | Cianci et al. | 206/45.31 |
| 4,669,610 | 6/1987 | Lindsey et al. | 206/320 |

*Primary Examiner*—A. A. Mathews

*Attorney, Agent, or Firm*—Russell E. Hattis

[57] ABSTRACT

A packaged camera assembly comprises an outer box having a top wall with an uncovered aperture and an inner sealed package containing a camera and camera accessories. The inner sealed package comprises transparent top and bottom telescoping container sections sealed together at their peripheries at the bottom of the container through which the camera and accessories are visible. The transparent top wall of the top clam shell container section has portions projecting through the aperture in the top wall of the box which retain the inner sealed assembly in place within the box. The bottom container section has a pouch-receiving recess positioned to one side of said the camera. A double-tiered recessed section is provided in the bottom container section which includes an upper shallow recess designed to receive a camera instruction tape cassette. The bottom of the shallow recess has a floor with a first opening communicating with a film box-receiving compartment below the floor and a second opening which defines a pass-through opening for flash batteries which can be snap fitted into a second compartment beneath the floor.

15 Claims, 4 Drawing Sheets

PACKAGED CAMERA ASSEMBLY

FIELD OF THE INVENTION

The present invention relates to the packaging of cameras and camera accessories, preferably in transparent clam shell containers. Clam shell containers for cameras generally comprise top and bottom transparent synthetic plastic container-forming sections sealed at their peripheries, to securely enclose a camera and sometimes such accessories as a camera pouch, film box and batteries. The preferred packaged camera assembly of the present invention also includes an instruction tape cassette which informs the user how to use the camera most effectively. It can be purely a sound tape cassette or a video tape cassette.

BACKGROUND OF THE INVENTION

It has heretofore been common to package cameras and camera accessories in lower price ranges in clam shell containers which have mounting holes at the top thereof for suspending the containers on horizontal support rods. These containers are commonly constructed in a manner which are not suitable for gift wrapping or for insertion into an outer conventional rectangular box for gift purposes.

These prior clam shell containers sometimes had a bottom or rear container section having recesses for receiving the camera and camera accessories. These containers also have a top or front section which were transparent and sealed to the periphery of the bottom or rear container section by a heat seal which sealed the camera and its accessories in the spaces between the sections of the clam shell container. The recesses for receiving the camera and camera accessories have been designed in such a way that there is very little flexibility of use for the clam shell container sections. If, for example, it was desired to package the same camera with fewer accessories, a completely different container had to be used.

Another prior art camera package located the camera within a conventional type rectangular box which could be readily gift-wrapped. On the front of this box was a large uncovered aperture through which the camera in the box could be viewed. The camera was held securely in the box by a transparent strap which tightly extended across the front face of the camera. The camera was not readily visible and the box was otherwise not designed in a manner to accommodate camera accessories.

The present invention provides a unique packaged camera which includes a sealed camera package which can be conveniently snap-fitted within a more or less conventional outer cardboard box with an uncovered aperture in the front wall thereof by merely pushing the package into the box. In one form thereof, the sealed camera package need not be marketed in an outer box. It is provided with a hole for suspending it on a horizontal support rod. Also, in the preferred form, the sealed camera package is designed so that a variety of camera accessories including a sound or video tape cassette, and different combinations thereof, can be readily supported in a variety of different positions in the same basic clam shell container.

SUMMARY OF THE INVENTION

In the most preferred form of the invention, the packaged camera assembly includes an outer, rectangular box of more or less conventional shape and construction. It has a large aperture in the top wall thereof which has no covering. Inside this box is an inner sealed camera package of a unique design and relationship to the outer box. The inner sealed package most preferably includes a transparent clam shell container where a top transparent section of the clam shell container is sealed at its periphery to a bottom section thereof for security reasons. In accordance with one feature of the invention, the top container section has transparent, window-forming portions projecting upwardly through the aperture of the outer box along two pairs of opposite margins of the aperture. These margins hold the inner sealed camera package against movement in the outer box. The sealed camera preferably is snap-fitted in the box by merely pushing the package into an opening in the box until it is fully inserted therein.

In accordance with another feature of the invention, a camera pouch, camera instruction cassette, film box and flash batteries are selectively placeable in a number of different unique arrangements in the bottom section of the clam shell container. To this end, a unique double-tiered recessed section is provided in the bottom container section which can selectively receive either the batteries and film box or the instruction cassette. Also, the bottom clam shell container section has a pouch-receiving recess or pocket which preferably extends the full thickness of the bottom clam shell container section. In one parts arrangement, the pouch fits in an uncompressed state in this recess and the cassette is placed in the upper tier of the double-tiered recessed section of the bottom container section. In another parts arrangement, the instruction cassette fits between the pouch and the transparent top wall of the top container section when the pouch is in a compressed state. The resiliency of the pouch forces the labelled top wall of the cassette against the transparent top wall of the top clam shell container section where it can be easily read. The bottom clam shell container section also has a recess or pocket for the camera. The top wall of the camera is preferably immediately below the transparent top wall of the top container section where it is readily visible in the aperture of the outer box, as are the camera accessories.

The double-tiered recessed section of the bottom clam shell container section is designed to receive AA or AAA batteries and the 35 mm film box when the instruction tape cassette is supported on the pouch. The upper tier of this recessed section has a shallow recess defined by an apertured floor and side walls for receiving the cassette when the battery and film supplies are not to be packaged with the camera. When the cassette is in this shallow recess, the labelled top wall of the cassette is in a plane immediately behind the top wall of the top container section where it can be easily read. The floor of this recess has one aperture communicating with a film box-receiving compartment therebelow and a second aperture communicating with a battery-receiving compartment therebelow for receiving either AA batteries oriented in one direction snap-fitted beneath this floor or AAA batteries oriented at right angles thereto and snap-fitted beneath this floor.

In another embodiment of the invention, where the sealed camera package is not to be enclosed within an outer box, the package is provided with a support rod-receiving aperture so that it can be hung on a horizontal support rod. In such case, in order to provide printed matter for this variation of the invention, the double-tiered section of the bottom clam shell container section would be fully or partially covered by a labelling sheet or card adhesively or otherwise secured to the top of the bottom container section. This labelling sheet or card would contain the trademark and some of the other printed information which the outer box described would include.

The above and other features of the invention will become apparent upon making reference to the specification to follow, the claims and the drawings.

DESCRIPTION OF EXEMPLARY EMBODIMENTS OF THE INVENTION SHOWN IN THE DRAWINGS

Figure 1:
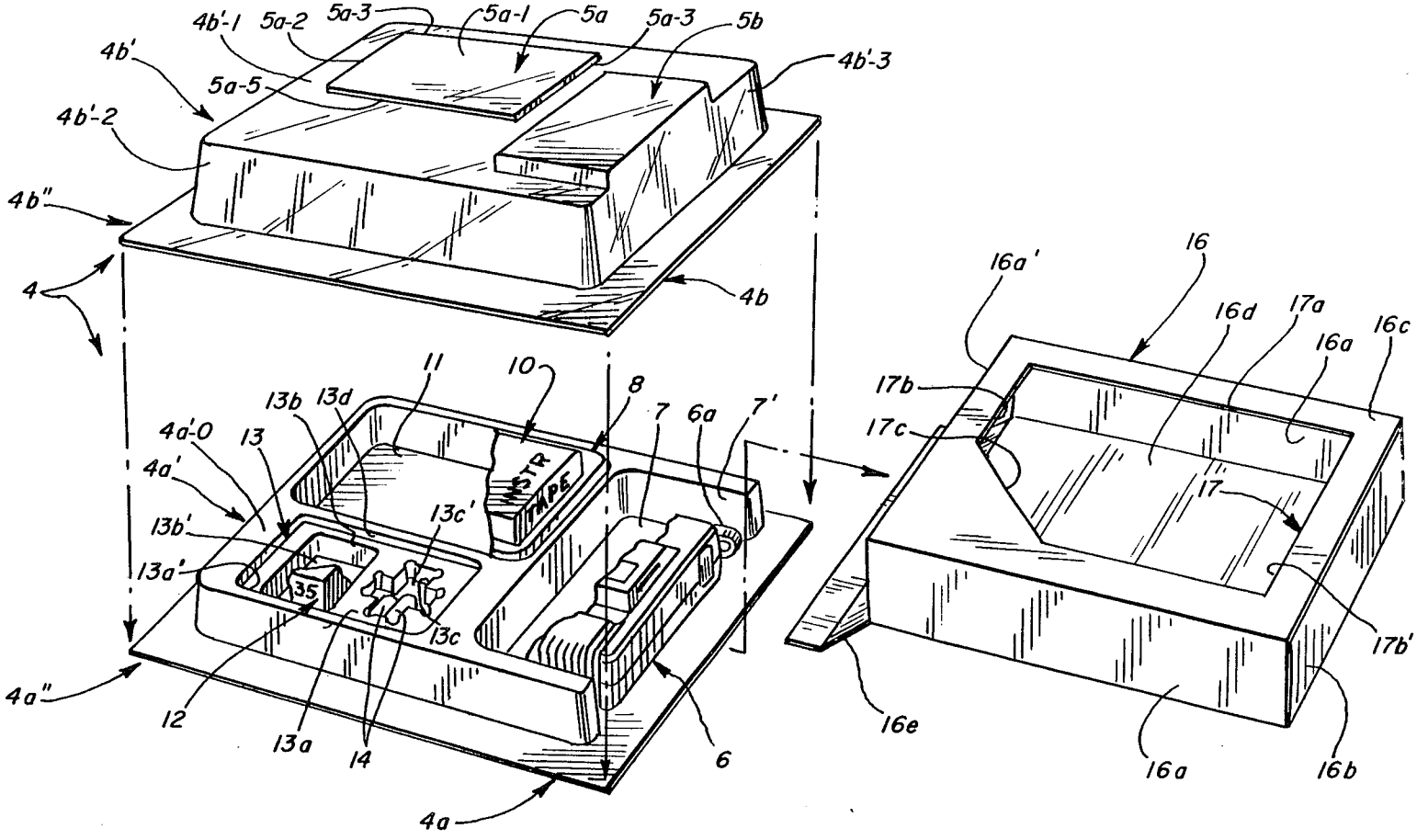
FIG. 1 is an exploded view of the different components making up the packaged camera assembly of the most preferred form of the invention.

Refer now more particularly to FIG. 1 which shows an exploded view of the preferred packaged camera assembly of the invention. This assembly includes an inner sealed camera package comprising a transparent clam shell container 4 having bottom and top container sections 4*a* and 4*b* sealed around a camera 6 and camera accessories to be described. This sealed camera package is insertable into an opening exposed by the opening of a flap 16*e* of a box 16. This box has side walls 16*a*—16*a* and 16*b*, a bottom wall 16*d* and a top wall 16*c*. The top wall 16*c* has an aperture 17 through which projects upwardly projecting portions 5*a* and 5*b* of the upper clam shell container section 4*b*. When the sealed camera package is slipped fully into the opening of the box 16, the upwardly projecting portions 5*a* and 5*b* of the upper clam shell container section 4*b* will snap fit into the box aperture 17 to retain the sealed camera package in a fixed position within the box. The bottom and top container sections 4*a* and 4*b* both have similarly upwardly projecting telescoping portions 4*a*′ and 4*b*′, respectively, with peripheral flanges 4*a*″ and 4*b*″ which are in confronting sealing relationship at the bottom of the container. The flanges form a flat support for the sealed camera package.

Figure 2:
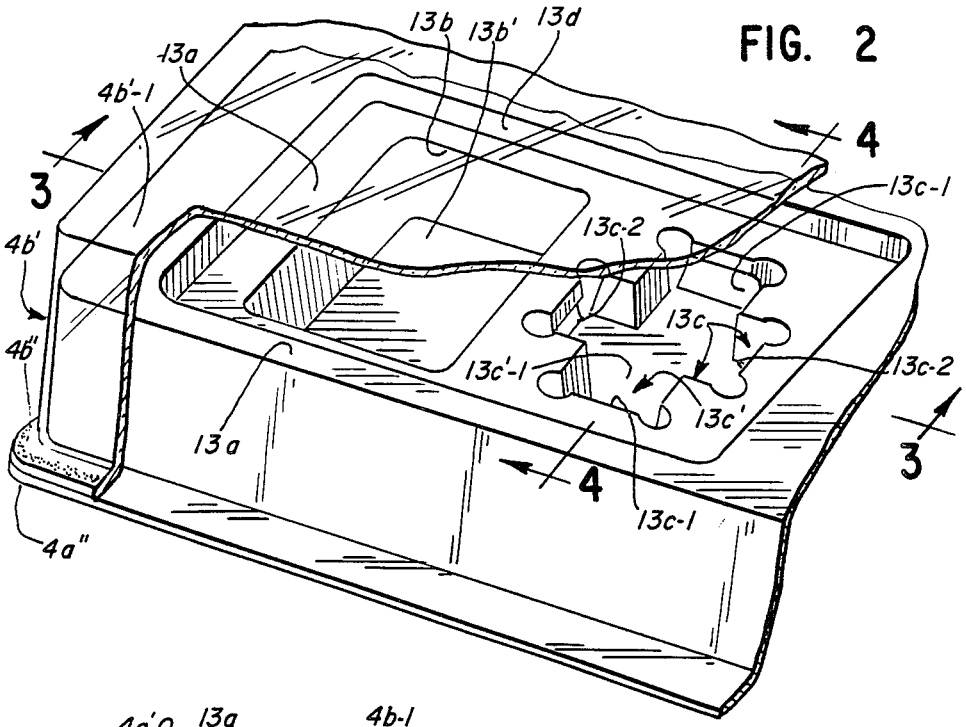
FIG. 2 is a fragmentary perspective view, partly broken away, of only the inner sealed camera package portion of the entire assembly shown in FIGS. 5–7 a portion of the packaged camera assembly which shows a double-tiered recess section of the bottom clam shell container section.
Figure 3:
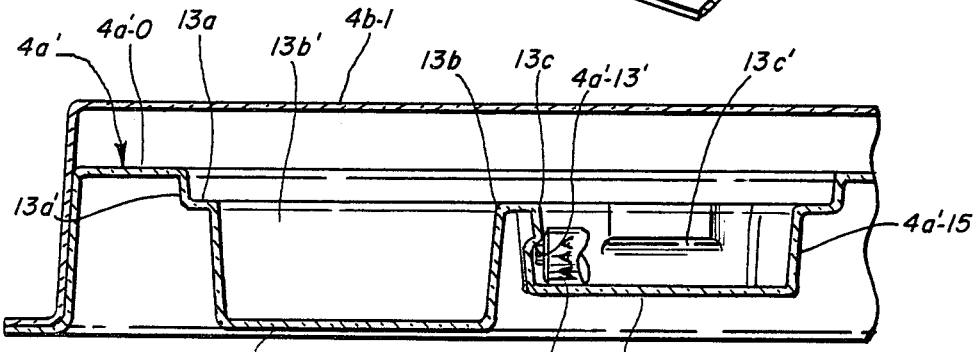
FIG. 3 is a sectional view through FIG. 2, taken along section line 3—3.
Figure 4:
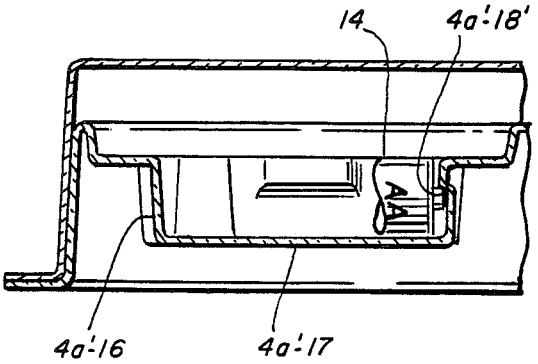
FIG. 4 is a sectional view through FIG. 2, taken along section line 4—4.
Figure 6:
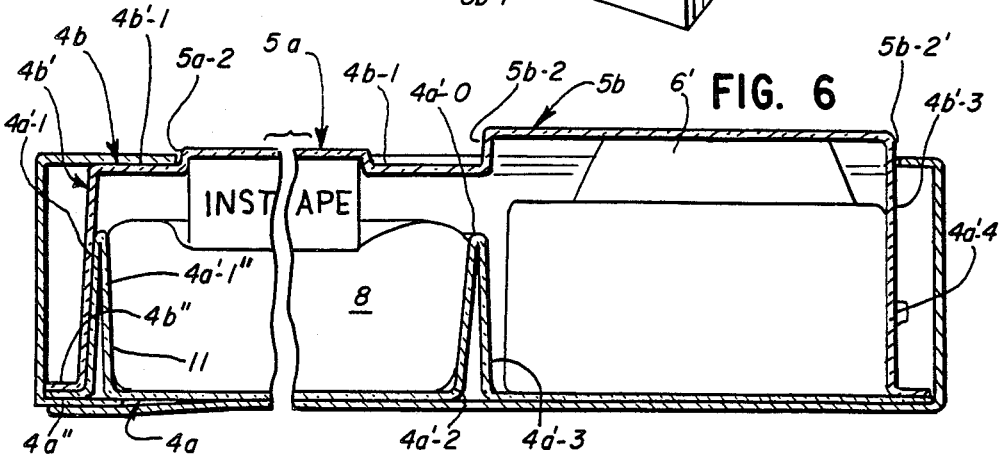
FIG. 6 is a longitudinal sectional view through the packaged camera assembly of FIG. 5, taken along section line 6—6 therein.
Figure 7:
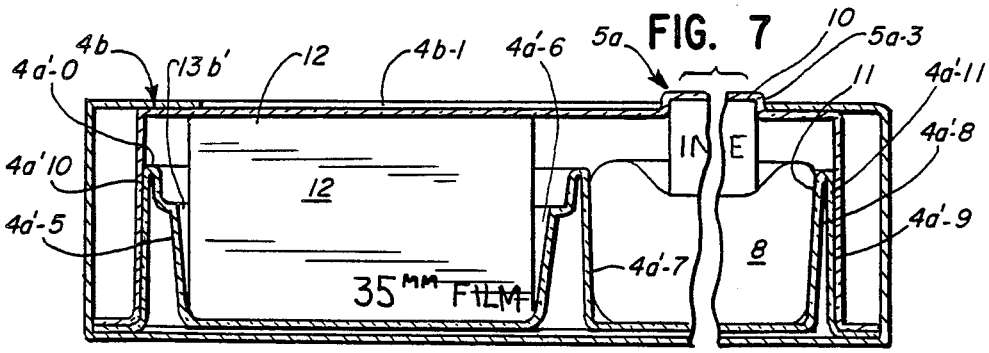
FIG. 7 is a transverse sectional view through the packaged camera assembly of FIG. 5, taken along section line 7—7.

The upwardly projecting portion 4*b*′ of the upper container section 4*b* has a main top wall 4*b*′-1 which is above the corresponding top wall 4*a*′-0 of the upwardly projecting portion 4*a*′ of the bottom container section, as best shown in FIG. 7. There is provided in the top wall 4*a*′-0 of the bottom container section 4*a* a recess 7 for receiving what is illustrated as a 35 mm camera 6, a recess 11 for receiving a compressible resilient pouch 8 which is compressed by an instruction tape cassette 10 sandwiched between the pouch 8 and the upwardly projecting portion 5*a* of the top wall 4*b*′-1 of the upper container section 4*b*, as best shown in FIG. 6. The bottom container section 4*a* contains a double-tiered recessed section 13 adjacent the recess 11 to be more fully described. This double-tiered section is adapted selectively to receive a film box 12 within a compartment 13*b*′ having a bottom wall 4*a*′-12 (FIG. 3) raised slightly above the bottom of the container, so that when the film box is seated on this wall, the top face of the film box will be contiguous to the top wall 4*b*′-1 of the top container section 4*b*. The double-tiered container section 13 also includes a compartment 13*c*′ which is adapted to receive in snap-fitted relation a pair of AA or AAA batteries 14. The compartment 13*c*′ has transverse extensions 13*c*-1 (FIG. 2) adapted to receive the AAA batteries beneath shoulders 4*a*′-18′ (FIG. 4) and longitudinal extensions 3*c*-2 for receiving in snap-fitted relation AA batteries beneath shoulders 4*a*′-13′ (FIG. 3).

The double-tiered section 13 now being described has an upper shallow cassette-receiving recess defined by a floor or seat 13*a* having an aperture 13*b* leading to the film box compartment 13*b*′ and an aperture 13*c* leading to the battery-receiving compartment 13*c*′. This upper recess has side walls 13*d* which conform generally in size and shape to the outer margins of the instruction cassette 10. In the absence of the film box 12 and batteries 14, this recess defined by the floor 13*a* and side walls 13*d* receive this cassette 10, as illustrated in the alternate accessory arrangement shown in FIG. 8.

The walls of the various recesses in the bottom container section are, as are all of the walls thereof, molded walls of about the same thickness. FIGS. 6 and 7 identify the vertically extending ones of these walls by reference numbers 4*a*′-1, 4*a*′-2, 4*a*′-3 . . . and 4*a*′-11.

To minimize the size of the clam shell container, the camera-receiving recess 7 is open to the outer side of the bottom container section 4*a*. This recess is closed off to hold the camera in place by the side wall 4*b*′-3 *(FIG. 1) of the upper clam shell container section 4b*′. This relationship of the wall 4*b*′-3 to the camera-receiving recess 7 is also shown in FIG. 6.

Figure 5:
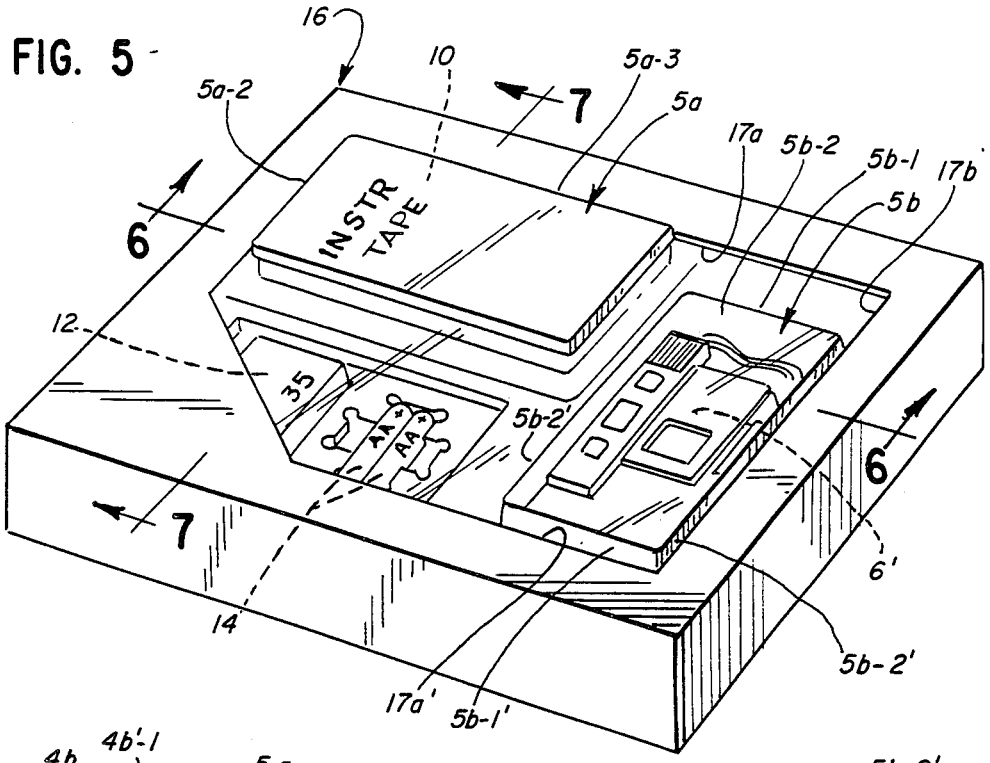
FIG. 5 is a top perspective view of the sealed inner camera package shown in FIGS. 2–4 placed within the outer box shown in FIG. 1.

The upwardly projecting portion 5*b* of the upper clam shell container section 4*b*′ has side walls 5*b*-1 and 5*b*-1′ and 5*b*-2 and 5*b*-2′ and a top wall 5*b*-2 which form a space for receiving the projecting front wall portion 6′ of the camera 6, as best shown in FIG. 6. The side wall 5*b*-1′ and the side wall 5*b*-2′ of the upwardly projectring portion 5*b* of the top wall 4*b*′-1 fall along two of the margins 17*a*′ and 17*b* of the aperture 17 formed in the top wall 16*c* of the outer box 16, to stabilize the position of the sealed camera package in the box. This relationship of the side walls 5b-1 and 5b-2' is best shown in FIG. 5.

The upwardly projecting portion 5a of the top wall 4b'-1 of the top clam shell container section 4b has a top wall 5a-1 and side walls 5a-2, 5a-3, 5a-4, and 5a-5 (FIG. 1) which define a recess aligned with the margins of the pouch-receiving recess 11 in the bottom clam shell container section 4a. The side walls 5a-2 and 5a-3 of the upwardly projecting portion 5a of the top container section 4b fit along the margins 17a and 17b of the outer box aperture 17, as best shown in FIGS. 5, 6, and 7, to aid in retaining the inner sealed camera package in position within the box 16.

Figure 8:
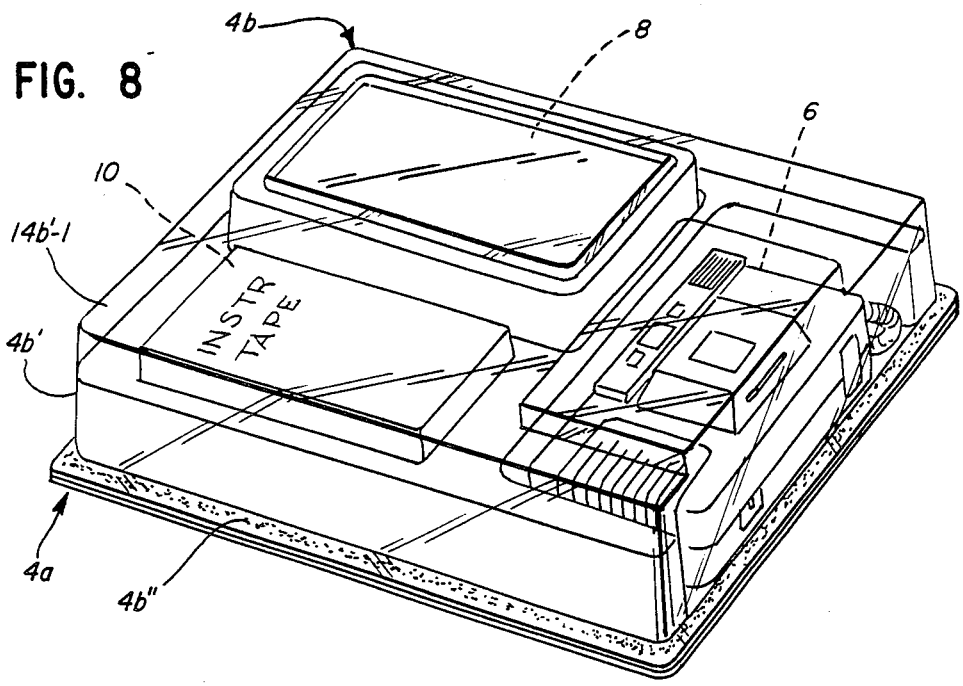
FIG. 8 is a view of the inner sealed camera package of the invention where a film box and batteries are not incorporated into the package and the instruction cassette is relocated from a position on top of the pouch to a separate recess of the container involved.

Refer now to FIG. 8 which shows the sealed package of the invention with a modified accessory arrangement. In the accessory arrangement, the camera supplies, namely the film box 12 and batteries 14 previously described, are omitted from the package. In such case, the instruction tape 10 is relocated from its previous position above the camera pouch 8 to a position within the shallow recess formed by the floor 13a and side walls 13d of the double-tiered section 13 of the bottom clam shell container section 4a. The cassette 10 just fits in the space defined between the floor 13a and the top wall 4b'-1 of the top container section 4b so that the information contained on the top wall of the cassette can be easily read.

Figure 9:
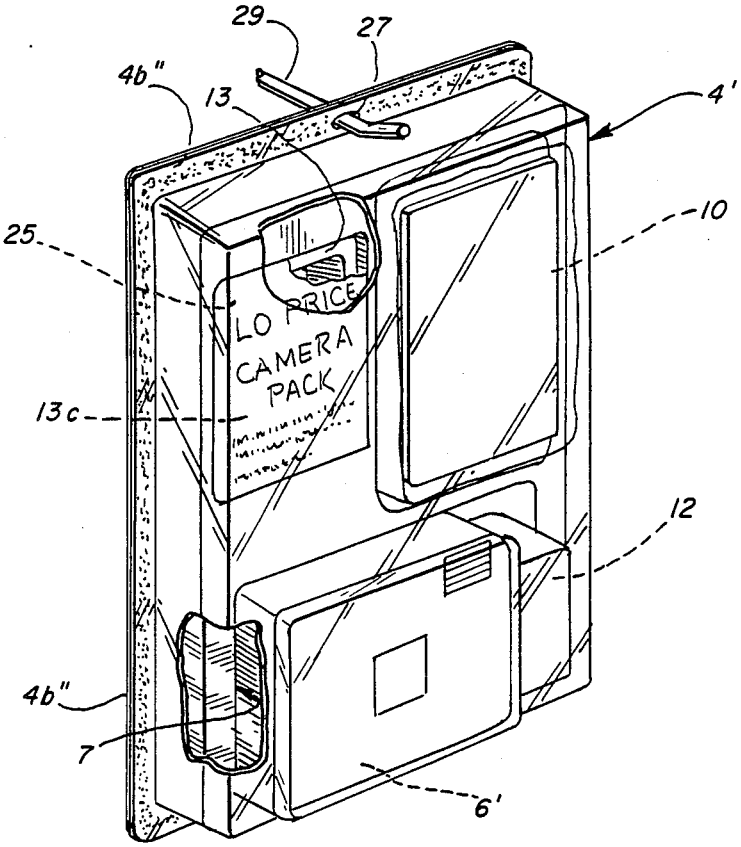
FIG. 9 is a modified sealed camera package where the package includes a hang rod-receiving aperture for supporting the sealed camera package on a horizontal support rod, and also shows the package containing a smaller 35 mm camera than that shown in the other figures, which leaves room in a camera-receiving recess in the lower section of the container there shown for the insertion of a film box.

Reference should now be made to FIG. 9 which shows a modified clam shell container 4' and a modified camera and film box arrangement therein from that shown in the other drawings. The clam shell container 4' is identical to the clam shell container 4 shown in the other drawings except that it includes in the peripheral flanges 4b''-1 and 4a''-1 of what in FIG. 9 are the top (now front) and bottom (now rear) clam shell container sections a hang rod-receiving aperture 27 which receives a hang rod 29 thereon for displaying the packaged camera. The double-tiered section 13 of the bottom clam shell container section has a label 25 adhesively secured thereover to take the place of the printed material applied (not shown) to the outer box 16 in the form of the invention shown in FIGS. 1 and 5. If batteries are provided, they can be supported within the compartment 13c' of the bottom clam shell container section. The label 25 may completely cover the batteries, or the label could be shorter than that shown in FIG. 9 to fully expose the batteries. The clam shell container 4' includes a 35 mm camera 6' which is substantially narrower than the camera 6 shown in the other drawings. There is, therefore, left a space in the camera-receiving recess 7 to one side of the camera which can accommodate the film box 12.

The various forms of the invention have thus provided an extremely flexible sealed camera package insertable within an outer box 16, or hangable upon a horizontal support rod. The basic unique design of the clam shell container adapts it for convenient assembly into the outer box 16 especially because of the projections 5a and 5b of the top clam shell container section which snap-fit uniquely within the outer box aperture 17. Also, the bottom clam shell container section 4a has a unique placement, dimensioning and configuration of recesses which permit flexibility in the supporting of the cameras of different sizes and camera accessories in various arrangements depending upon marketing needs.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

We claim:

1. In a packaged camera assembly including an outer box having a top wall with an uncovered aperture in the same; and an inner sealed package containing at least a camera, said inner sealed package including a clam shell container comprising top and bottom container sections sealed together at their periphery, the bottom container section having said camera supported thereon, at least the top container section having a transparent top wall through which said camera is visible, the improvement wherein said transparent top wall of said top clam shell container section has portions projecting through said aperture in the top wall of said box, said aperture having two pairs of transversely related opposite margins along which said projecting portions of said top clam shell container section extend so that these margins retain said inner sealed assembly in place within said box.

2. The packaged camera assembly of claim 1 wherein said outer box has a cover flap movable between a position where it is inserted into said box to a position where it is folded away from the box to expose an opening into the box into which said inner sealed package can be passed into said box where it initially tightly fits within said box, said portions of said top wall of the top clam shell container section which project through said aperture in the top wall of said box snap fitting into said aperture in the top wall of said box when the inner sealed package is almost fully inserted within the box.

3. The packaged camera assembly of claims 1 or 2 wherein there is supported on said bottom clam shell container section a camera accessory which is located to one side of said camera thereon; said projecting portions of the top clam shell container section comprising separated first and second upwardly projecting portions which follow the outlines respectively of said camera and said camera accessory, to aid in the retention of said camera and camera accessory upon said bottom clam shell container section.

4. The packaged camera assembly of claim 1 wherein there is supported on said bottom clam shell container section at least one camera accessory located in a first section at a point to one side of said camera, said top clam shell container section having separated upwardly projecting portions following the outlines respectively of and partially enclosing portions of the camera and said at least one camera accessory to aid in retaining the same in place on said bottom clam shell container section, at least two of said upwardly projecting portions of said top clam shell container section being said portions projecting into said apeture in said top wall of said box.

5. In a packaged camera assembly comprising a clam shell container including top and bottom container sections having spaced confronting central portions defining camera and camera accessory-receiving spaces therebetween and peripheral portions sealed together, a camera, a carrying pouch for said camera and at least one other camera accessory supported in said spaces; the improvement wherein said bottom container section has a first recess generally the shape of said camera and forming a pocket receiving the same, a second recess positioned to one side of said first recess and following generally the outlines of said pouch to form a pocket which receives said pouch, said pouch being made of a soft compressible material, and at least a third shallow recess designed to receive a camera instruction tape cassette, the bottom of said shallow cassette-receiving recess being defined by a floor parallel to the top of said container section so that when said cassette is supported on said floor, the cassette is contiguous to the top of said top clam shell container section, the floor of said recess having a first opening communicating with a first film box-receiving compartment below said floor so that, in the absence of said cassette, a film box can fit into said first compartment, there being a second opening in said floor of said cassette-receiving recess which defines a passthrough opening for flash batteries which can be snap fitted into a second compartment beneath the floor of said shallow cassette-receiving recess, the cassette being of a thickness wherein when said compartments below said floor are filled with said film box and batteries, the cassette can fit in the space between the compressed camera pouch in said second recess and said top clam shell container section.

6. In a packaged camera assembly comprising a container including top and bottom container sections having spaced confronting central portions defining camera and camera accessory-receiving spaces therebetween, a camera and at least one other camera accessory supported in said spaces; the improvement wherein said bottom container section is designed to receive at least a camera and an instruction tape cassette accessory and has a shallow recess designed to receive a camera instruction tape cassette, the bottom of said shallow cassette-receiving recess being defined by a floor parallel to the top of said bottom container section so that, when said cassette is supported on said floor, the cassette is contiguous to the top of said top container section, the floor of said recess having a first opening communicating with a first film box-receiving compartment below said floor so that, in the absence of said cassette, a film box can fit into said first compartment, there being a second opening in said floor of said cassette-receiving recess which defines a pass-through opening for flash batteries which can be snap fitted into a second compartment beneath the floor of said shallow cassette-receiving recess.

7. The packaged camera assembly of claim 5 or 6 wherein said film box is in said first compartment and said batteries are in said second compartment.

8. The packaged camera assembly of claim 5 wherein said film box is in said first compartment, the batteries are in said second compartment, and said cassette is sandwiched between said compressed pouch and said top clam shell container section.

9. The packaged camera assembly of claims 5 or 6 wherein the packaged camera assembly includes an outer box having a top wall with an uncovered aperture in the same; said container having portions projecting through said aperture in the top wall of said box, said aperture having two pairs of transversely related opposite margins along which said projecting portions of said container extends, so that these margins retain said container in place within said box.

10. The packaged camera assembly of claim 1, 5, or 6 wherein said container has support rod-receiving openings for supporting said container on a horizontal support rod.

11. The packaged camera assembly of claim 5 or 6 wherein said second opening and compartment in said floor is sized to receive AA batteries when oriented in one direction therein and AAA batteries when oriented in a direction transverse to said one direction.

12. The packaged camera assembly of claim 10 wherein there is a label secured over said shallow recess.

13. The packaged camera assembly of claim 5 wherein said first recess for receiving said camera is open on the outside thereof and said container section has a side wall closing off said open recess.

14. The packaged camera assembly of claim 1, 5 or 6 wherein said top and bottom container sections have upwardly extending telescoping portions with vertically spaced upper extremities between which said spaces are defined and bottom sealed peripheral flanges in a common horizontal plane for seating the container and forming a flat seat for the assembly when it is resting on a horizontal support surface in a box or on a display shelf.

15. The packaged camera assembly of claim 14 wherein the top profile of said container is generally parallel to said common horizontal support plane of said flanges.

* * * * *